US007287600B2

(12) United States Patent
Braun

(10) Patent No.: US 7,287,600 B2
(45) Date of Patent: Oct. 30, 2007

(54) HAMMER DRILL WITH WOBBLE MECHANISM AND HOLLOW DRIVE SHAFT

(75) Inventor: Willy Braun, Neustetten (DE)

(73) Assignee: Robert Bosch GmbH, Stuttgart (DE)

( * ) Notice: Subject to any disclaimer, the term of this patent is extended or adjusted under 35 U.S.C. 154(b) by 171 days.

(21) Appl. No.: 11/139,716

(22) Filed: May 27, 2005

(65) Prior Publication Data

US 2006/0289181 A1 Dec. 28, 2006

(30) Foreign Application Priority Data

Jun. 2, 2004 (DE) ..... 10 2004 026 845

(51) Int. Cl.
*B25D 16/00* (2006.01)

(52) U.S. Cl. ..... 173/48; 173/109; 173/216; 173/217

(58) Field of Classification Search ..... 173/93.5, 173/90, 217, 216, 48, 205, 109, 96, 47, 104
See application file for complete search history.

(56) References Cited

U.S. PATENT DOCUMENTS

| | | | | |
|---|---|---|---|---|
| 4,446,931 | A | 5/1984 | Bleicher et al. | |
| 4,537,264 | A * | 8/1985 | Schmid et al. | 173/48 |
| 4,719,976 | A * | 1/1988 | Bleicher et al. | 173/109 |
| 5,036,925 | A * | 8/1991 | Wache | 173/48 |
| 5,052,497 | A * | 10/1991 | Houben et al. | 173/109 |
| 5,277,259 | A * | 1/1994 | Schmid et al. | 173/48 |
| 5,379,848 | A * | 1/1995 | Rauser | 173/48 |
| 5,435,397 | A * | 7/1995 | Demuth | 173/109 |
| 6,035,945 | A * | 3/2000 | Ichijyou et al. | 173/48 |
| 6,460,627 | B1 * | 10/2002 | Below et al. | 173/48 |
| 6,988,563 | B2 * | 1/2006 | Hashimoto et al. | 173/48 |
| 7,021,401 | B2 * | 4/2006 | Droste et al. | 173/109 |
| 7,070,008 | B2 * | 7/2006 | Baumann et al. | 173/48 |
| 2002/0134563 | A1 * | 9/2002 | Stirm | 173/201 |
| 2004/0188117 | A1 * | 9/2004 | Lebisch et al. | 173/48 |
| 2005/0263306 | A1 * | 12/2005 | Frauhammer et al. | 173/48 |
| 2006/0048955 | A1 * | 3/2006 | Saur et al. | 173/48 |

FOREIGN PATENT DOCUMENTS

GB 2380442 4/2003

* cited by examiner

*Primary Examiner*—Stephen F. Gerrity
(74) *Attorney, Agent, or Firm*—Michael J. Striker

(57) ABSTRACT

A hand power tool has a housing, a drive motor and a gear mechanism arranged in the housing. A tool receptacle accommodates a tool, and a gear wheel drives a rotary sleeve in rotation from the drive motor and the gear mechanism and thereby the tool receptacle. A hammering mechanism is located inside the rotary sleeve and drivable translationally via a wobble gear. The gear mechanism has a driving gear wheel meshing with a motor pinion and arranged on a shaft by which the wobble gear mechanism is drivable to revolve. The shaft is configured as a hollow shaft on which the driving gear wheel is retained nondisplaceably and in a manner fixed against rotation. The wobble gear mechanism is located adjacent to the driving gear wheel on the shaft rotatably and couplably to the hollow shaft.

32 Claims, 4 Drawing Sheets

HAMMER DRILL WITH WOBBLE MECHANISM AND HOLLOW DRIVE SHAFT

CROSS-REFERENCE

The invention described and claimed hereinbelow is also described in DE 102004026845.2, filed Jun. 2, 2004. This German Patent Application, whose subject matter is incorporated here by reference, provides the basis for a claim of priority of invention under 35 U.S.C. 119 (a)-(d).

BACKGROUND OF THE INVENTION

The invention is based on a hand power tool, in particular a drilling hammer and/or jackhammer.

Known hand power tools of this type have an L-shaped construction, in which the gear mechanism is embodied as a single-stage cone wheel gear, and the drive mechanism of the hammering mechanism is embodied as a wobble gear mechanism. Both the driving gear wheel embodied as a cone wheel and the wobble gear mechanism are located on one shaft, which makes for a space-saving, compact mode of construction. A disadvantage of such hand power tools, however, is that in terms of their functions they are limited to two functions, namely hammer drilling and chiseling. A different hand power tool of a similar kind likewise makes only two functions possible, specifically hammer drilling and drilling.

On the other hand, hand power tools in the form of so-called combination devices, also of L-shaped construction, are also known in which the hammering mechanism is likewise drivable via a wobble gear mechanism; these hand power tools have a two-stage gear mechanism construction. Such hand power tools, as combination devices, make three functions possible, namely drilling, hammer drilling, and chiseling. However, these hand power tools have the disadvantage of a complicated, expensive construction with a large number of components, because of the individual gear and bearing stages, and therefore have the disadvantage of reduced efficiency. Moreover, these hand power tools have a relatively high weight, and because of the internal space required also have correspondingly large dimensions and are therefore not as handy as is desired.

SUMMARY OF THE INVENTION

It is therefore an object of the present invention to provide a hand power tool which eliminates the disadvantages of the prior art.

In keeping with these objects and with others which will become apparent hereinafter, one feature of the present invention resides, briefly stated, in a hand power tool, comprising a housing; a drive motor and a gear mechanism arranged in said housing; a tool receptacle in which a tool is guidable; a gear wheel via which a rotary sleeve is driven in rotation from said drive motor and said gear mechanism and thereby said tool receptacle is driven in rotation; a hammering mechanism located inside said rotary sleeve and drivable translationally via a wobble gear, said gear mechanism having a driving gear wheel meshing with a motor pinion and arranged on a shaft by which said wobble gear mechanism is drivable to revolve, said shaft being configured as a hollow shaft on which said driving gear wheel is retained nondisplaceably and in a manner fixed against rotation, said wobble gear mechanism being located adjacent to said driving gear wheel on said shaft rotatably and couplably to said hollow shaft.

The hand power tool according to the invention has the following advantages over the prior art: In itself, the hand power tool combines a merely one-stage gear mechanism, with the consequence of a space-saving, compact, lightweight construction, as well as its design as a combination tool, which makes all functions possible, that is, at least drilling, hammer drilling and chiseling.

A reduction in the number of gear and bearing stages and thus in the number of necessary components is achieved. Bundling the functions together leads to a design that is shorter by about 30 mm, for instance, with at the same time an insignificant increase in the dimensions in height. The reduction in gear and bearing stages increases the efficiency. An overall economy of material and expense is achieved.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
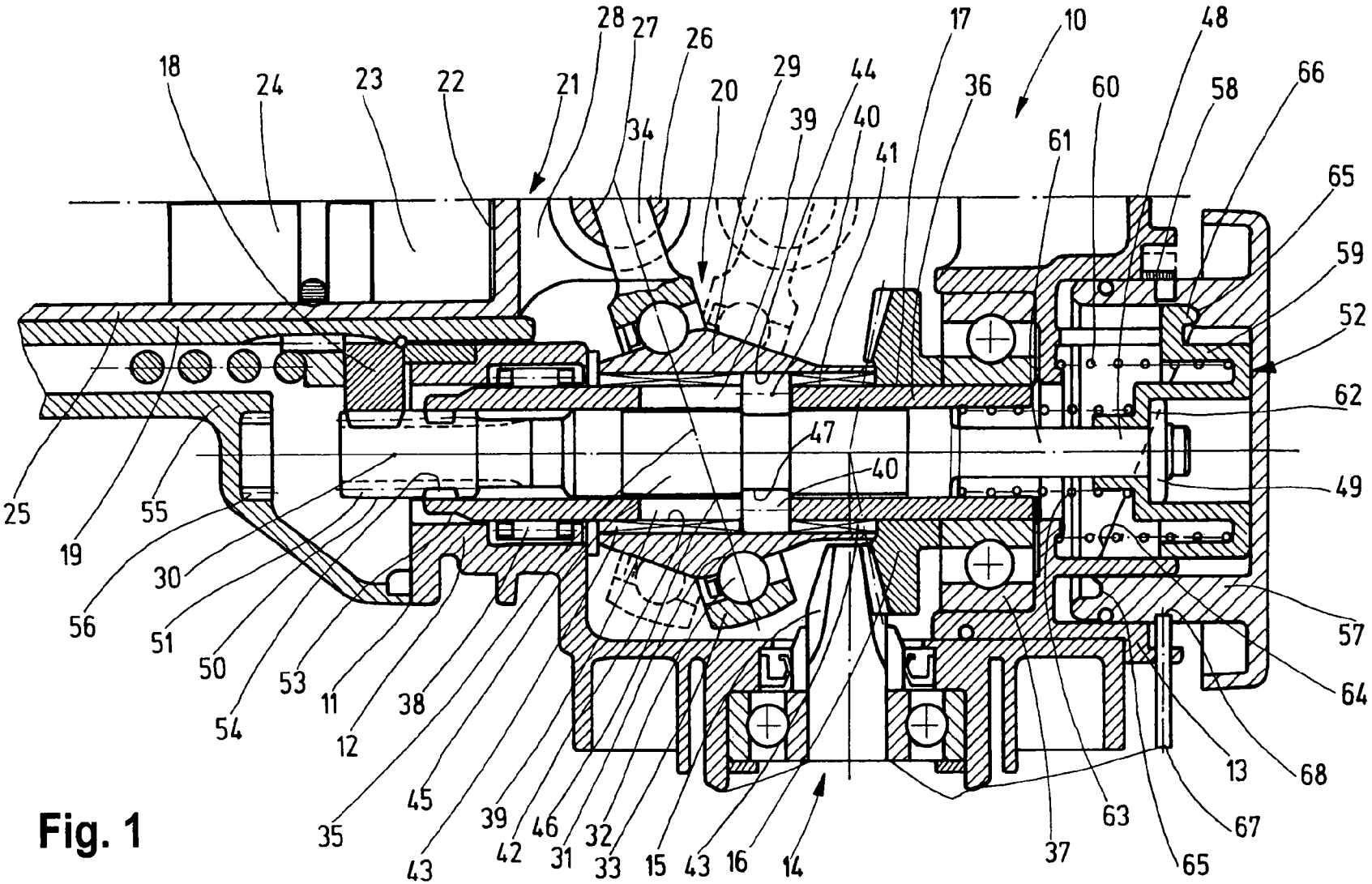
FIG. 1 shows a schematic axial longitudinal section of a detail of a hand power tool in the function position for drilling.

In the drawings, a detail of interest here is schematically shown of a hand power tool 10 which is embodied in particular as a drilling hammer and/or jackhammer. The hand power tool 10 has a housing 11, which includes a gearbox 12, a bearing flange 13, and a hammering mechanism housing 55. The housing 11 includes an approximately vertically oriented, in particular electrical, drive motor that is not otherwise visible and that via a gear mechanism 14 acts on a downstream drilling and/or hammering mechanism. The gear mechanism 14 has a motor pinion 15, embodied in particular as a conical pinion with an approximately vertical axial course in terms of the drawing.

The motor pinion 15 is driven by the drive motor, not shown, and meshes with a driving gear wheel 16, which is embodied in particular as a cone wheel. The driving gear wheel 16 is retained axially nondisplaceably and in a manner fixed against relative rotation on a shaft 17. Via the shaft 17 and a gear wheel 18, in particular a spur wheel, a rotary sleeve 19, which can also be called a drilling shaft, is driven to rotate. The gear wheel 18 is coupled in the circumferential direction with the rotary sleeve 19 in a way that transmits torque, and between it and the rotary sleeve 19, there may also be a safety coupling, not further shown. Via the gear wheel 18 and the rotary sleeve 19, a tool receptacle, not further shown, in which a tool can be guided, can be driven to rotate.

By means of the gear mechanism 14, specifically the motor pinion 15, the driving gear wheel 16, and the shaft 17, a hammering mechanism 21 can be driven translationally via a wobble gear mechanism 20; the hammering mechanism is located here inside the rotary sleeve 19 and is embodied in particular as an air cushion hammering mechanism. The hammering mechanism 21 has a drive piston 22 that is movable back and forth and acts upon a beater 24 via an air cushion 23. In the exemplary embodiment shown, the drive piston 22 is embodied as a hollow piston, which is guided displaceably inside the rotary sleeve 19 and which in its interior contains the beater 24. This part 24, called a beater, may instead be a further piston, in which case a beater then adjoins it farther to the left in the drawing.

The tool not shown is received in the tool receptacle in such a way that upon being driven to rotate it is slaved in the circumferential direction and is movable back and forth in the tool receptacle on being driven via the hammering mechanism 21 and is acted upon with the percussion energy by the beater in a way that is usual in such drilling hammer and/or jackhammers. The cylindrical wall of the hollow drive piston 22 is identified by reference numeral 25 and represents a guide tube for the beater 24 or a corresponding piston. On the outer end of the drive piston 22, a rotary bolt 26 with a transverse bore 27 is retained in a fork 28.

The wobble gear mechanism 20 has a wobble body 29, which has an annular groove 31 extending obliquely to the longitudinal center axis 30; a ring 33 is rotatably supported on this annular groove via balls 32. The ring 33 has a slaving bolt 34, which extends inside the diagonal plane 35 and is received with play in the transverse bore 27 of the rotary bolt 26. Upon a revolving driving motion of the wobble body 29, the ring 33 wobbles back and forth with the slaving bolt 34 between the position shown in dashed lines and the position shown in solid lines, and as a result the drive piston 22 is driven axially back and forth.

In a special feature, the shaft 17 is embodied as a hollow shaft 36, on which the driving gear wheel 16 is retained nondisplaceably and in a manner fixed against relative rotation; the driving gear wheel can be press-fitted onto the hollow shaft. The wobble gear mechanism 20 with the wobble body 29 is also rotatable on the hollow shaft 36, adjacent to the driving gear wheel 16, and in such a way that it can be coupled to the hollow shaft 36.

The hollow shaft 36 is rotatably supported on both ends by means of bearings in the housing 11, specifically by means of a fixed bearing 37, for instance in the form of a ball bearing, on one end and by means of a loose bearing 38, for instance in the form of a needle bearing, on the other. The fixed bearing 37 is received in the bearing flange 13. The loose bearing 38 is retained in the gearbox 12.

On an approximately middle axial portion, the hollow shaft 36 has a plurality of radially passable oblong slots 39, distributed over the circumferential direction, each of which contains a transmission element 40, which for instance comprises a roller, in particular a cylindrical body, or instead a ball or the like. The transmission elements 40 protrude radially outward past the outer circumferential face 41 of the hollow shaft 36 and can thereby enter into engagement with the wobble gear mechanism 20, in particular the wobble body 29, as a result of which the wobble gear mechanism 20 is couplable with the hollow shaft 36 for rotary slaving.

Figure 2:
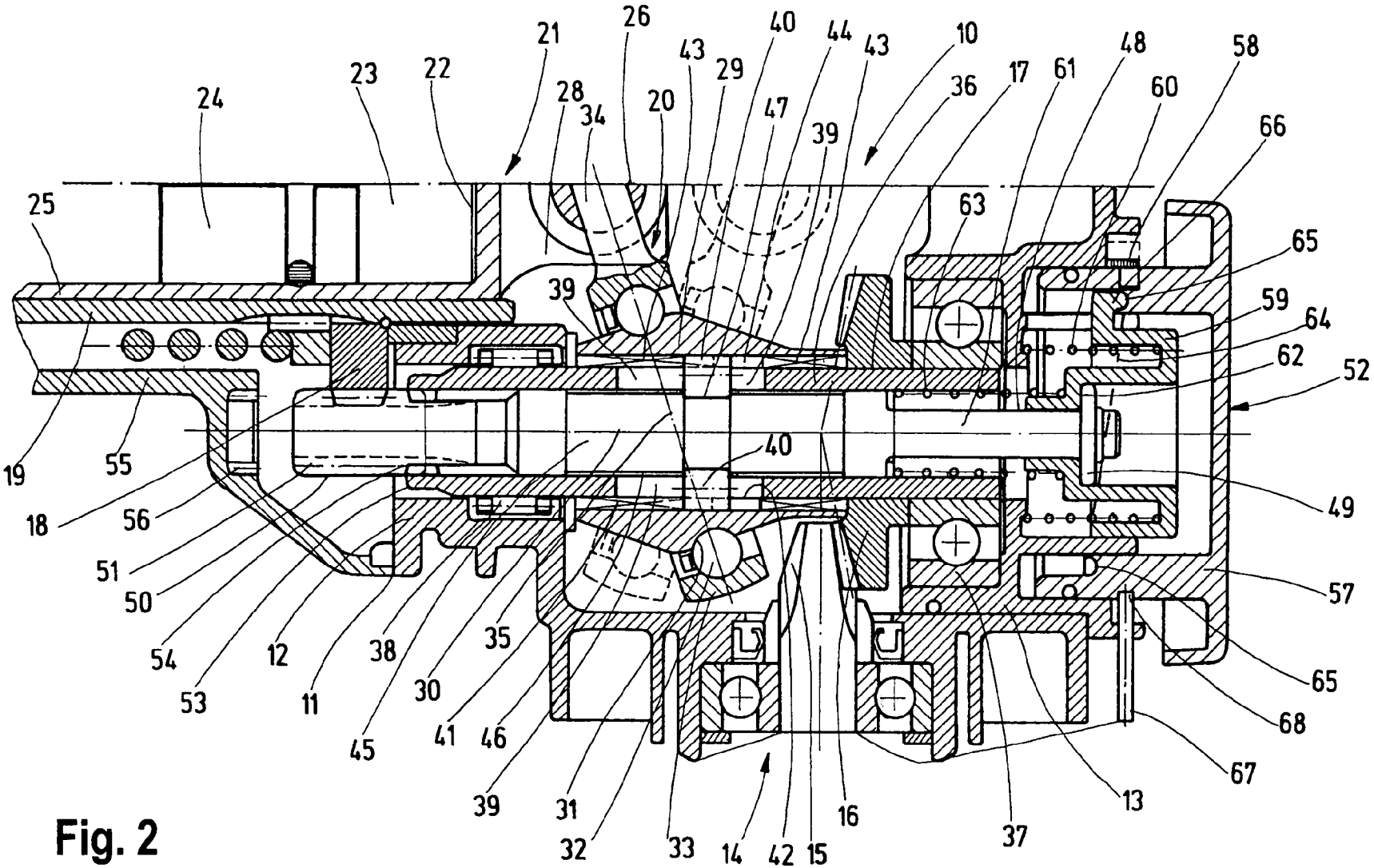
FIG. 2 is a view corresponding to that of FIG. 1, but in the function position for hammer drilling.
Figure 3:
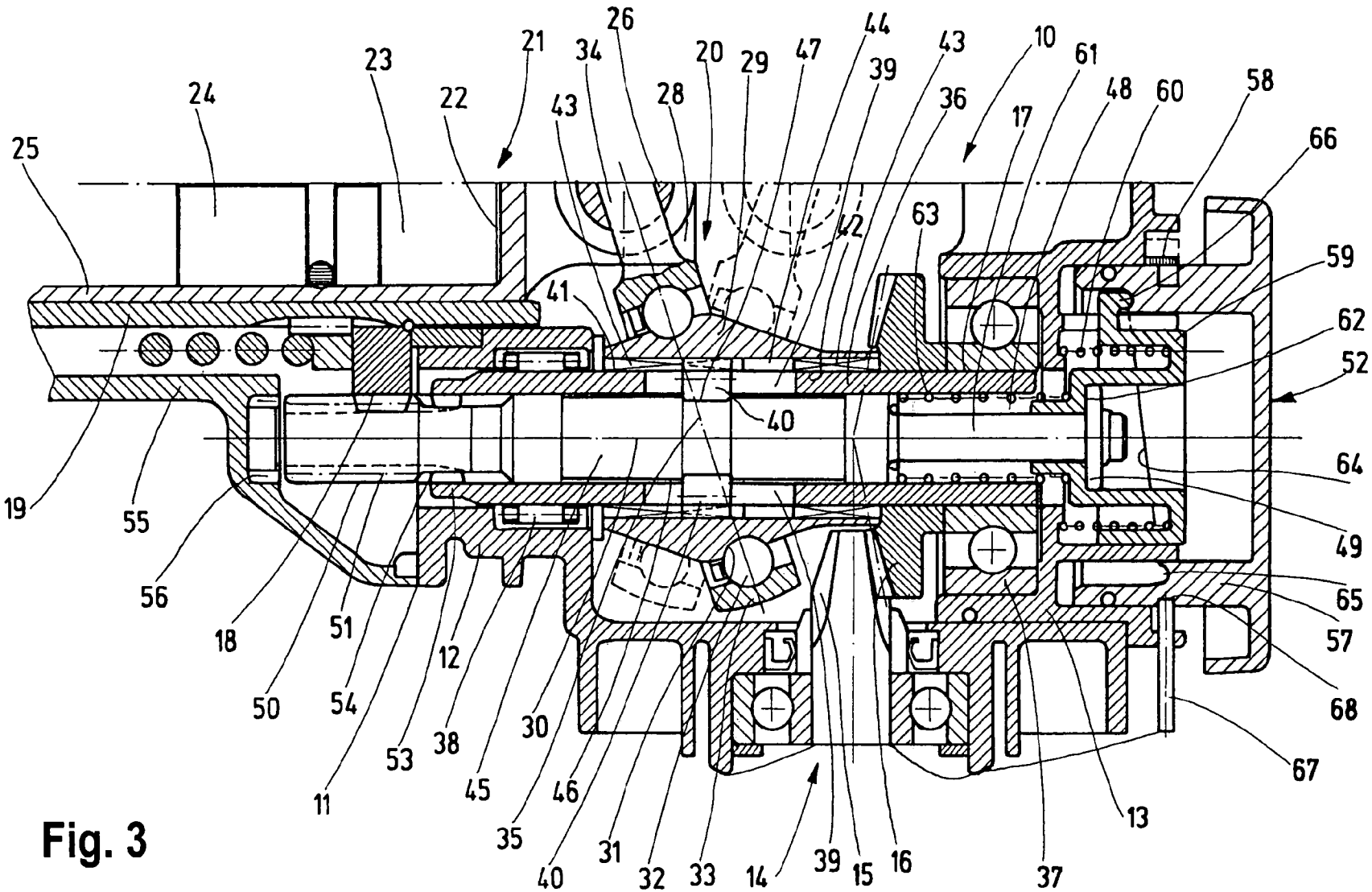
FIG. 3 is a view corresponding to that of FIG. 1, but in the vario-lock function position.
Figure 4:
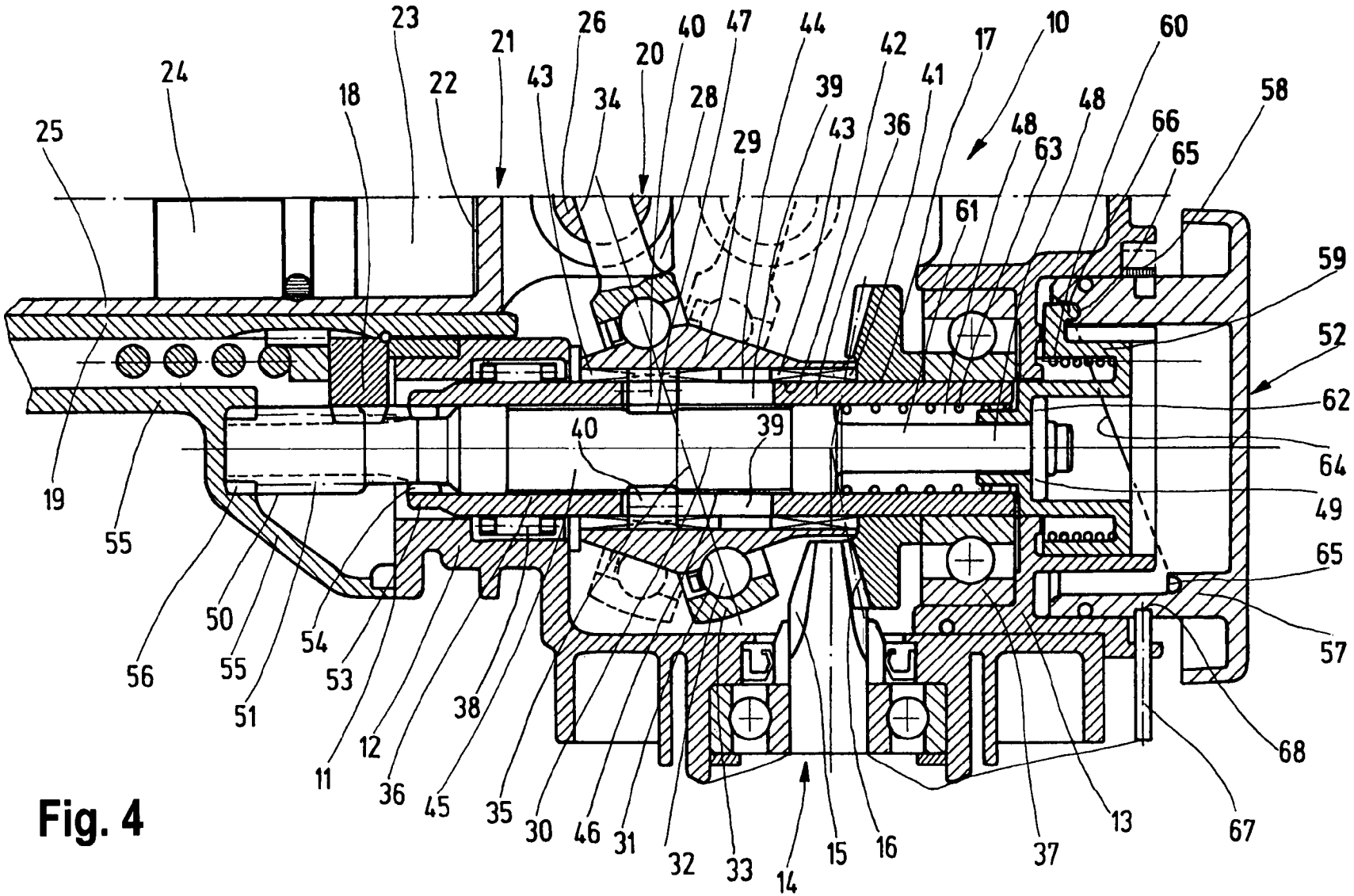
FIG. 4 is a view corresponding to that of FIG. 1, but in the function position for chiseling.

The wobble body 29, on its inner circumferential face 42, has a plurality of longitudinal recesses 43, such as longitudinal grooves, which can be engaged on the inside by the transmission elements 40 by axial motion as shown in FIGS. 2 through 4. The longitudinal recesses 43 are interrupted, for example approximately in the region of the middle, by an encompassing groove 44, in which the transmission elements 40 can revolve freely without a form-locking connection with the wobble body 29. This function position is shown in FIG. 1, in which the transmission elements 40, with the region protruding past the outer circumferential face 41, engage the inside of the encompassing groove 44 but not the longitudinal recesses 43.

A switching shaft 45 is supported axially displaceably and received freely movably inside the hollow shaft 36. Axially displacing the switching shaft 45 makes it possible to set all the operating modes of the hand power tool 10, that is, drilling, hammer-drilling, vario-lock, and chiseling, as is shown in FIGS. 1 through 4 in different axial positions of the switching shaft 45. On its outer circumferential face 46, the switching shaft 45 has an encompassing recess 47, in particular an encompassing groove, whose axial width is for instance approximately equal to that of the transmission elements 40.

The transmission elements 40, protruding radially inward past the hollow shaft 36, engage the inside of this recess 47, in particular the encompassing groove, in a form-locking manner and remain in form-locking engagement with this recess 47 in every displaced position of the switching shaft 45. The switching shaft 45 is thus axially displaceable, together with the transmission elements 40 engaging the recess 47, relative to the hollow shaft 36 and the wobble gear mechanism 20, in particular the wobble body 29, thereon between positions in which the transmission elements 40 engage the longitudinal recesses 43, in particular longitudinal grooves, of the wobble body 29 in a form-locking manner for its rotary slaving (FIGS. 2 through 4), and a position shown in FIG. 1, in which the transmission elements 40 can engage the encompassing groove 44 of the wobble body 29 and roll along therein.

The switching shaft 45 has an actuating portion 48, located on the right in the drawings, with a stop disk 49 and on the other end has an end portion 50, which is provided with an external toothing 51, for instance with longitudinally oriented teeth, and in particular with a spline shaft toothing. The actuating portion 48, in particular the stop disk 49, is engaged by an actuating device 52 for axial displacement of the switching shaft 45. The toothing 51 on the end portion 50 is embodied as a spur toothing and meshes, in the various relative axial displacement positions of the switching shaft 45, with the gear wheel 18, in particular the spur wheel, of the rotary sleeve 19.

In an end region 53 that is associated with the end portion 50 of the switching shaft 45 that has the toothing 51, the hollow shaft 36 has a slaving part 54, for instance an internal toothing, that is axially aligned with the toothing 51 of the switching shaft 45. The toothing 51 of the switching shaft 45 in form-locking engagement with this slaving part 54 in a plurality of axial displacement positions, which correspond to the functions of drilling and hammer drilling. In the axial displacement position of the switching shaft 45 that corresponds to the vario-lock or chiseling function (FIG. 3 and FIG. 4, respectively), the toothed slaving part 54 of the hollow shaft 36 is conversely not in form-locking engagement with the toothing 51 of the switching shaft 45; see FIGS. 3 and 4. The slaving part 54, in particular the internal toothing, of the hollow shaft 36, being merely a slaving toothing, does not make stringent demands in terms of quality and can therefore be manufactured economically by non-metal-cutting shaping, such as rolling, pressing, or the like. This is favorable for the sake of an economical mode of construction.

The housing 11, in particular its hammering mechanism housing 55, has a blocking part 56 axially aligned with the toothing 51 of the end portion 50 of the switching shaft 45, such as an internally-toothed hollow wheel part integral with it. Upon displacement of the switching shaft 45 into the function position for chiseling (FIG. 4), the switching shaft, with its toothing 51, can be brought axially into blocking engagement with the toothing of the blocking part 56.

The wobble gear mechanism 20, in particular the wobble body 29, is supported with a clearance fit directly on the outer circumferential face 41 of the hollow shaft 36 and thereby retained axially nondisplaceably between the driving gear wheel 16 on the one hand and the housing 11, in particular the gearbox 12, on the other. When the hammering mechanism 21 is operative, involving hammering mechanism forces that act primarily axially rearward, these forces are diverted directly via the fixed bearing 37 of the hollow shaft 36 into the bearing flange 13 and from there onward into the gearbox 12.

The actuating device 52 is located on the back end of the hand power tool 10. On the housing 11, for instance on the bearing flange 13, it has a rotary actuator 57, in particular a selector wheel, which is coaxial to the switching shaft 45 and can be rotated about the longitudinal center axis 30 into various positions. The latching and holding of the rotary actuator 57 in the particular desired switching position can be implemented for instance by means of a hexagonal profiling of the rotary actuator 57 in combination with a leaf spring 58. Still other possibilities for doing this are within the scope of the invention.

Another component of the actuating device 52 is a switching member 59, which is axially displaceable by means of the rotary actuator 57 and is embodied for instance as a switching bell. The switching member 59 activates the actuating portion 48, in particular the stop disk 49, of the switching shaft 45 for axially displacing the switching shaft. The switching member 59 is axially pressed against the rotary actuator 57 by a compression spring 60. The compression spring 60 is supported on one end on the bearing flange 13 and on the other on the switching member 59.

The switching member 59 is thus axially displaceable to the left in FIG. 1, counter to the action of an axial restoring force generated by the compression spring 60. The switching member 59 is penetrated by a bolt 61 of the actuating portion 48, whose stop disk 49, forming a slaving means, rests on a bottom face 62 of the switching member 59 that is pressed axially to the right in FIG. 1 against the stop disk 49 via the compression spring 60. Upon the rotary actuation of the rotary actuator 57, the switching member 59 is displaceable to the left, beginning at 51, relative to the actuating portion 48, counter to the action of the compression spring 60.

Between the switching member 59 and the switching shaft 45, there is also an axial compression spring 63, which acts as a synchronizing spring. If beginning at the position shown in FIG. 1 the switching member 59 is displaced axially to the left by rotary actuation of the rotary actuator 57, counter to the action of the compression springs 60 and 63.

If despite the action of the compression spring 63 the switching shaft 45 remains in the position because the transmission elements 40 do not immediately axially engage the inside of the longitudinal recesses 43 of the wobble body 29, or the toothing 51 of the switching shaft 45 for instance does not move axially into the blocking part 56, in particular the internally-toothed hollow wheel part, of the hammering mechanism housing 55, then the compression spring 63 is prestressed between the switching member 59 and the switching shaft 45. Once the synchronization takes place after that, the compression spring 63 causes an axial displacement of the switching shaft 45, far enough that the transmission elements 40 axially engage the longitudinal recesses 43, or the toothing 51 engages the blocking part 56, and in the process causes the stop disk 49 to strike the bottom face 62.

The rotary actuator 57, in particular the selector wheel, of the actuating device 52 has an obliquely extending end face 64, which is preferably provided with a groovelike indentation 65 that is open toward the left in terms of FIG. 1. The switching member 59 has a lug 66, which engages the indentation 65 and is held in this engaged position in the indentation 65 by the action of the compression spring 60. The switching member 59 is guided nonrotatably, but axially displaceably, in the housing 11, for instance in the bearing flange 13, for instance by means of a longitudinal slit in the bearing flange 13 which is engaged in a form-locking manner by a part of the switching member 59. Rotating the rotary actuator 57 can impose an axial motion on the switching member 59, whereupon the rotary actuator 57 can be rotated continuously in an arbitrary direction without an end stop. Slaved rotation of the switching member 59 is prevented in the process. Depending on the direction of motion of the switching member 59, the axial displacement is transmitted, either via the stop disk 49 or via the compression spring 63 acting as a synchronizing spring, to the switching shaft 45 and to the transmission elements 40 that engage the encompassing recess 47.

If a bidirectional motion is realized in the hand power tool 10 by means of a function part, not shown, in particular a rotatable brush plate, that makes this motion possible, then it may be advantageous if the counterclockwise travel can be switched on only in the drilling position shown in FIG. 1, but not in the hammer drilling position of FIG. 2 or the chiseling position of FIG. 4. The preclusion of counterclockwise travel in these positions makes it possible to design and optimize the fan of the drive motor in one direction of rotation. In that case, incorrect use in the hammer-drilling mode (FIG. 2) is furthermore precluded. To that end, an arresting member 67, such as an arresting bar, is assigned to the rotary actuator 57 and meshes with an outer cam path 68 of the rotary actuator 57 and is actuatable by the rotary actuator 57 in the rotary positions that correspond to the hammer-drilling mode and the chiseling-drilling mode, in such a way that a blockage of rotation of the rotatable function part, in particular a rotatable brush plate, is brought about.

In the functional position of the switching shaft 45 as shown in FIG. 1, only a rotational drive of the rotary sleeve 19 and via it of the tool receptacle and of the tool is effected. The hand power tool 10 is in the drilling mode of operation. The rotational drive exerted by the motor pinion 15 on the driving gear wheel 16 and the hollow shaft 36 connected to it in a manner fixed against relative rotation is transmitted by the hollow shaft 36, via its slaving part 54 in the form of the internal toothing, the toothing 51 of the switching shaft 45, and the gear wheel 18 meshing with it, to this gear wheel and to the rotary sleeve 19, which is as a result driven to rotate. The transmission elements 40 are not in engagement with the longitudinal recesses 43 of the wobble body 29. Although upon revolution of the hollow shaft 36 the transmission elements 40 are slaved to the hollow shaft, nevertheless for the lack of form locking between the transmission elements 40 and the wobble body 29, the hammering mechanism 21 is not in operation. The transmission elements 40, for instance slaving rollers, rotate without loading in the encompassing groove 44 of the fixed wobble body 29.

In FIG. 2, the switching shaft 45 is in a position displaced to the left compared to FIG. 1, and in this position the transmission elements 40 revolving by means of the hollow shaft 36 are moved outward axially into the longitudinal recesses 43, in particular longitudinal grooves, of the wobble body 29. Because the hollow shaft 36 is driven to rotate, the wobble body 29 is driven to revolve by its form lock with it. The hammering mechanism 21 is thus activated. Since moreover the hollow shaft 36, with its internally toothed slaving part 54, continues to be in engagement with the toothing 51, and the gear wheel 18 is meshing with the latter toothing, the gear wheel 18 and the rotary sleeve 19 are also driven to revolve because of the rotational drive of the hollow shaft 36 via the toothing 51. The tool, not shown, is thus driven to rotate at the same time. The function position here is hammer drilling.

The position shown in FIG. 3, in which the switching shaft 45 is displaced still farther to the left compared to FIG. 2, is the vario-lock function position. In this position, the tool, together with the rotary sleeve 19 and the gear wheel 18, can be rotated into a desired working position without the expenditure of force; this is because the hollow shaft 36, with its internally toothed slaving part 54, is axially out of engagement with the toothing 51 of the switching shaft 45, which is thus rotatable from the tool upon rotary actuation of the rotary sleeve 19 and the gear wheel 18. The transmission elements 40 continue to be in engagement with the longitudinal recesses 43, in particular longitudinal grooves, of the wobble body 29.

In the function position of FIG. 4, the switching shaft 45 is displaced all the way to the right axially, into the position in which its toothing 51 meshes in a form-locking manner with the internally toothed blocking part 56 of the hammering mechanism housing 55, and as a result the switching shaft 45 is prevented from rotating. Since the internally toothed slaving part 54 of the hollow shaft 36 is not in engagement with the toothing 51 of the switching shaft 45, the driven hollow shaft 36 can revolve relative to the nonrotatably fixed switching shaft 45; the slaved transmission elements 40 slave the wobble body 29 in the direction of revolution, since the transmission elements 40 are in form-locking engagement, in this axial position as well, with the longitudinal recesses 43, in particular longitudinal grooves, of the wobble body 29.

The hand power tool 10 described, in terms of its gear mechanism 14, requires only a single-stage cone wheel gear with the motor pinion 15 and the driving gear wheel 16. The hand power tool 10 makes all the functions of drilling, hammer drilling, vario-lock and chiseling possible. The hand power tool 10 is compact in structure and economical. The number of components and gear stages is reduced to a small amount. With this design of the hand power tool 10, a shorter construction, for instance about 30 mm shorter, is possible, while any slight increase in height is insignificant.

It will be understood that each of the elements described above, or two or more together, may also find a useful application in other types of constructions differing from the types described above.

While the invention has been illustrated and described as embodied in hand power tool, in particular a drilling hammer and/or jackhammer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hand power tool, comprising a housing; a drive motor and a gear mechanism arranged in said housing; a tool receptacle in which a tool is guidable; a gear wheel via which a rotary sleeve is driven in rotation from said drive motor and said gear mechanism and thereby said tool receptacle is driven in rotation; a hammering mechanism located inside said rotary sleeve and drivable translationally via a wobble gear mechanism, said gear mechanism having a driving gear wheel meshing with a motor pinion and arranged on a shaft by which said wobble gear mechanism is drivable to revolve, said shaft being configured as a hollow shaft on which said driving gear wheel is retained nondisplaceably and in a manner fixed against rotation, said wobble gear mechanism being located adjacent to said driving gear wheel on said shaft rotatably and couplably to said hollow shaft, wherein said hollow shaft includes transmission elements which are separate from said hollow shaft and supported in radially passable oblong slots, by means of which separate transmission elements said wobble gear mechanism is couplable with said hollow shaft in a circumferential direction for rotary slaving.

2. A hand power tool as defined in claim 1, wherein said drive motor is an electrical drive motor.

3. A hand power tool as defined in claim 1, wherein said hollow shaft has two ends; and further comprising bearings supporting said hollow shaft on said two ends in said housing.

4. A hand power tool as defined in claim 3, wherein said ends of said hollow shaft are supported in a bearing flange and in a gear box correspondingly.

5. A hand power tool as defined in claim 3, wherein one of said ends is supported in said housing by a fixed bearing formed as a ball bearing, while the other of said ends of said hollow shaft is supported in said housing by a loose bearing formed as a needle bearing.

6. A hand power tool as defined in claim 1, wherein said transmission elements are formed as elements selected from the group consisting of rollers, cylindrical bodies, or balls.

7. A hand power tool as defined in claim 1, wherein said wobble gear mechanism has a wobble body provided on its inner circumferential face with longitudinal recesses with which said transmission elements are meshable for form-locking rotary slaving, and with an encompassing groove in which said transmission elements are capable of revolving freely without a form-locking connection with said wobble gear mechanism.

8. A hand power tool as defined in claim 7, wherein said longitudinal recesses of said wobble body are formed as longitudinal grooves.

9. A hand power tool as defined in claim 7; and further comprising a switching shaft which is supported axially displaceably inside said hollow shaft and on its outer circumferential face has an encompassing recess into which said transmission elements, protruding radially inwards past said hollow shaft, engage, said switching shaft being displaceable together with said transmission elements relative to said hollow shaft and said wobble gear mechanism between positions in which said transmission elements mesh in a form-locking manner for rotary slaving with said longitudinal recesses of said wobble gear mechanism, and a position in which said transmission elements engage inside said encompassing groove of said wobble gear mechanism and revolve freely therein.

10. A hand power tool as defined in claim 9, wherein said encompassing recess of said switching shaft is formed as an encompassing groove.

11. A hand power tool as defined in claim 9; and further comprising an actuating device, said switching shaft having an actuating portion which is engaged by said actuating device for axial displacement, and an end portion provided with an outer toothing.

12. A hand power tool as defined in claim 11, wherein said outer toothing has longitudinally oriented teeth and is formed as a spline shaft toothing.

13. A hand power tool as defined in claim 11, wherein said end portion of said switching shaft meshes with said gear wheel of said rotary sleeve.

14. A hand power tool as defined in claim 13, wherein said gear wheel of said rotary sleeve is a spur gear wheel.

15. A hand power tool as defined in claim 14, wherein said blocking part is formed as an internally-toothed hollow wheel part.

16. A hand power tool as defined in claim 11, wherein said housing has a hammering mechanism housing with a blocking part which is axially aligned with said outer toothing of said end portion of said switching shaft and with which said outer toothing of said switching shaft is bringable into blocking engagement, in an axial displacement position corresponding to a chiseling function.

17. A hand power tool as defined in claim 11, wherein said hollow shaft in an end region that is associated with said end portion of said switching shaft that has said outer toothing, has a slaving part that is axially aligned with said outer toothing of said switching shaft, with which slaving part said outer toothing of said switching shaft is bringable into form-locking engagement in axial displacement positions which correspond to functions of drilling and hammer drilling, and is bringable out of engagement in an axial displacement position which corresponds to vario-lock or chiseling function.

18. A hand power tool as defined in claim 17, wherein said slaving part is formed as an internal toothing.

19. A hand power tool as defined in claim 11, wherein said actuating device on said housing has a rotary actuator that is coaxial with said switching shaft, and a switching member which is axially displaceable by said rotary actuator and which engages said actuating portion of said switching shaft for its axial displacement.

20. A hand power tool as defined in claim 19, wherein said switching member is axially displaceable counter to an action of an axial restoring force.

21. A hand power tool as defined in claim 20; and further comprising a spring which provides said action of said axially restoring force, against which said switching member is axially displaceable.

22. A hand power tool as defined in claim 21, wherein said spring is a compression spring which is located and is operative between said switching member and said housing.

23. A hand power tool as defined in claim 19, wherein said compression spring is located and is operative between said switching member and a bearing flange of said housing.

24. A hand power tool as defined in claim 19, wherein said switching member has a slaving means engaging a slaving means of said actuating portion of said switching shaft in a form-locking manner in an axial direction, and in an axial direction which is opposite to said first mentioned axial direction is displaceable relative to said slaving means of said actuating portion counter to an action of an axial compressing spring serving a purpose of synchronization, that is braced on said switching member and on said switching shaft.

25. A hand power tool as defined in claim 19, wherein said rotary actuator of said actuating device has an obliquely extending end face which said switching member engages with a lug for axial actuation, while said switching member is guided nonrotatably but axially displaceably in said housing.

26. A hand power tool as defined in claim 25, wherein said obliquely extending end face of said actuating device has a substantially groove shaped indentation.

27. A hand power tool as defined in claim 25; and further comprising an arresting member which is associated with said rotary actuator and meshing with said rotary actuator, and in rotary positions corresponding to a hammer drilling and chiseling mode is actuatable by said rotary actuator in a direction of a blockage of rotation of a rotatable functional part that makes bidirectional travel possible.

28. A hand power tool as defined in claim 27, wherein said rotary actuator is formed as a selector wheel, and said arresting member meshes with an outer cam path of said rotary actuator.

29. A hand power tool as defined in claim 11, wherein said actuating device is arranged on a bearing flange, and said rotary actuator is formed as a selector wheel.

30. A hand power tool as defined in claim 1, wherein said wobble gear mechanism is supported with a clearance fit on said hollow shaft and retained axially nondisplaceably between said driving gear wheel on the one hand and said housing on the other hand.

31. A hand power tool as defined in claim 30, wherein said wobble gear mechanism has a wobble body which is supported with said clearance fit on said hollow shaft and retained axially nondisplaceably between said driving gear wheel on the one hand and a gear box of said housing on the other hand.

32. A hand power tool, comprising a housing; a drive motor and a gear mechanism arranged in said housing; a tool receptacle in which a tool is guidable; a gear wheel via which a rotary sleeve is driven in rotation from said drive motor and said gear mechanism and thereby said tool receptacle is driven in rotation; a hammering mechanism located inside said rotary sleeve and drivable translationally via a wobble gear mechanism, said gear mechanism having a driving gear wheel meshing with a motor pinion and arranged on a shaft by which said wobble gear mechanism is drivable to revolve, said shaft being configured as a hollow shaft on which said driving gear wheel is retained nondisplaceably and in a manner fixed against rotation, said wobble gear mechanism being located adjacent to said driving gear wheel on said shaft rotatably and couplably to said hollow shaft, wherein said hollow shaft includes transmission elements supported in radially passable oblong slots, by means of which transmission elements said wobble gear mechanism is couplable with said hollow shaft in a circumferential direction for rotary slaving, wherein said wobble gear mechanism has a wobble body provided on its inner circumferential face with longitudinal recesses with which said transmission elements are meshable for form-locking rotary slaving, and with an encompassing groove in which said transmission elements are capable of revolving freely without a form-locking connection with said wobble gear mechanism, and further comprising a switching shaft which is supported axially displaceably inside said hollow shaft and on its outer circumferential face has an encompassing recess into which said transmission elements, protruding radially inwards past said hollow shaft, engage, said switching shaft being displaceable together with said transmission elements relative to said hollow shaft and said wobble gear mechanism between positions in which said transmission elements mesh in a form-locking manner for rotary slaving with said longitudinal recesses of said wobble gear mechanism, and a position in which said transmission elements engage inside said encompassing groove of said wobble gear mechanism and revolve freely therein.

* * * * *